US011180822B2

(12) United States Patent
Wang et al.

(10) Patent No.: US 11,180,822 B2
(45) Date of Patent: Nov. 23, 2021

(54) LOW-YIELD-RATIO ULTRA-HIGH-STRENGTH HOT-ROLLED QANDP STEEL AND PRODUCTION METHOD THEREFOR

(71) Applicant: BAOSHAN IRON & STEEL CO., LTD., Shanghai (CN)

(72) Inventors: Huanrong Wang, Shanghai (CN); Ana Yang, Shanghai (CN); Wei Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 1016 days.

(21) Appl. No.: 15/536,787

(22) PCT Filed: Nov. 24, 2015

(86) PCT No.: PCT/CN2015/095362
§ 371 (c)(1),
(2) Date: Jun. 16, 2017

(87) PCT Pub. No.: WO2016/095664
PCT Pub. Date: Jun. 23, 2016

(65) Prior Publication Data
US 2017/0342523 A1 Nov. 30, 2017

(30) Foreign Application Priority Data
Dec. 19, 2014 (CN) ..... 201410810278.5

(51) Int. Cl.
*C21D 9/46* (2006.01)
*C22C 38/12* (2006.01)
(Continued)

(52) U.S. Cl.
CPC ..... *C21D 9/46* (2013.01); *B22D 7/00* (2013.01); *C21C 7/10* (2013.01); *C21D 1/18* (2013.01);
(Continued)

(58) Field of Classification Search
CPC ..... C21D 9/46; C21D 8/0263; C21D 8/0226; C21D 8/0205; C21D 6/008; C21D 6/005;
(Continued)

(56) References Cited

U.S. PATENT DOCUMENTS 5,180,449 A 1/1993 Masui et al.
8,025,982 B2 * 9/2011 Futamura ..... C21D 8/02 428/659
(Continued)

FOREIGN PATENT DOCUMENTS

CN 102363859 A 2/2012
CN 102534372 A * 7/2012
(Continued)

OTHER PUBLICATIONS

Guo et al., CN102534372A. (machine translation). (Year: 2012).*
PCT/CN2015/095362 International Search Report and Written Opinion, dated Jan. 25, 2016.

*Primary Examiner* — John A Hevey
(74) *Attorney, Agent, or Firm* — Lei Fang; Smith Tempel Blaha LLC

(57) ABSTRACT

Disclosed is provided a low yield ratio and superhigh-strength hot-rolled Q&P steel and a method for manufacturing the same, having the following chemical composition in weight percentage: C: 0.2-0.3%, Si: 1.0-2.0%, Mn: 1.5-2.5%, P: ≤0.015%, S: ≤0.005%, Al: 0.5-1.0%, N: ≤0.006%, Nb: 0.02-0.06%, Ti: ≤0.03%, O: ≤0.003%, and the balance being Fe and inevitable impurities. The manufacture method comprises a stepped cooling process to finally obtain the steel with a three-phase structure containing a certain vol-
(Continued)

ume fraction of proeutectoid ferrite; martensite; and residual austenite, and having an excellent comprehensive performance with a yield strength of ≥600 MPa, a tensile strength of ≥1300 MPa, a good elongation, and a low yield ratio. The obtained Q&P steel also shows an excellent match of high plasticity suitable for easy deformabilities and wear-resistances.

9 Claims, 4 Drawing Sheets

(51) Int. Cl.

| | |
|---|---|
| ***C22C 38/14*** | (2006.01) |
| ***B22D 7/00*** | (2006.01) |
| ***C21C 7/10*** | (2006.01) |
| ***C21D 1/18*** | (2006.01) |
| ***C21D 6/00*** | (2006.01) |
| ***C21D 8/02*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 6/005* (2013.01); *C21D 6/008* (2013.01); *C21D 8/0205* (2013.01); *C21D 8/0226* (2013.01); *C21D 8/0263* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/001* (2013.01); *C21D 2211/005* (2013.01); *C21D 2211/008* (2013.01)

(58) Field of Classification Search
CPC ..... C21D 1/18; C21D 2211/008; C21D 2211/005; C21D 2211/001; C22C 38/06; C22C 38/04; C22C 38/02; C22C 38/002; C22C 38/001; C22C 33/04; C22C 38/14; C22C 38/12; C21C 7/10; B22D 7/00
See application file for complete search history.

(56) References Cited

U.S. PATENT DOCUMENTS

| | | | | |
|---|---|---|---|---|
| 2014/0234659 | A1* | 8/2014 | Kawata | C21D 8/1255 428/659 |
| 2014/0338798 | A1* | 11/2014 | Thomas | C22C 38/02 148/533 |
| 2016/0017449 | A1* | 1/2016 | Wang | C22C 38/04 148/546 |
| 2017/0051378 | A1* | 2/2017 | Lee | C21D 8/0226 |

FOREIGN PATENT DOCUMENTS

| | | | | |
|---|---|---|---|---|
| CN | 102534372 A | | 7/2012 | |
| CN | 103215516 A | * | 7/2013 | C22C 38/001 |
| CN | 103215516 A | | 7/2013 | |
| CN | 103233161 A | | 8/2013 | |
| CN | 104532126 A | | 4/2015 | |

* cited by examiner

LOW-YIELD-RATIO ULTRA-HIGH-STRENGTH HOT-ROLLED QANDP STEEL AND PRODUCTION METHOD THEREFOR

CROSS-REFERENCE TO RELATED APPLICATIONS

This application is a 371 U.S. National Phase of PCT International Application No. PCT/CN2015/095362, filed on Nov. 24, 2015, which claims benefit and priority to Chinese patent application No. 201410810278.5, filed on Dec. 19, 2014. Both of the above-referenced applications are incorporated by reference herein in their entirety.

TECHNICAL FIELD

The present invention relates to the field of wear-resistant steels, and relates to a low yield ratio and superhigh-strength hot-rolled Q&P steel and a method for manufacturing the same, the hot-rolled Q&P steel having a yield strength of ≥600 MPa, a tensile strength of ≥1300 MPa, an elongation of ≥10%, and a yield ratio of ≤0.5.

BACKGROUND ART

A quenching-partitioning steel, i.e., a Q&P steel, is a research hotspot in the field of advanced high-strength steels in present years, the main purpose being improving the plasticity of a steel, i.e., the product of the strength and elongation of the steel, while improving the strength of the steel.

The main process for a Q&P steel is: the steel is heated to a full austenite region or a partial austenite region, rapidly quenched to a certain temperature between Ms and Mf (Ms and Mf respectively represent the starting temperature and finishing temperature of martensite transformation) after experiencing a homogenization treatment for a period of time to obtain a martensite+residual austenite structure with a certain amount of residual austenite, which is then kept at a cooling stopping temperature of quenching or higher than the cooling stopping temperature such that carbon atoms are diffused to and enriched in the residual austenite from the oversaturated martensite, so as to stabilize the residual austenite, and then quenching is performed again to room temperature.

The initial research and application of Q&P steels mainly aim at the demand of high-strength and high-plasticity steels in the automobile industry. It can be seen, from the course of achieving the process for a Q&P steel, that the process route is more complex, and the steel, after the first quenching, requires a process of a rapid temperature increase to a certain temperature and maintaining for a period of time. Such a two-step Q&P process is difficult to achieve for a production process of hot rolling, but has a very good reference significance for the production of a hot-rolled high-strength steel. In the hot rolling process, a one-step Q&P process can be used, that is, after the completion of the final rolling, coiling is carried out after on-line quenching to a certain temperature not greater than Ms. A typical structure of a Q&P steel is martensite+a certain amount of residual austenite, thus having a high strength and a good plasticity.

Chinese patent CN 102226248 A introduces a carbon silicon manganese hot-rolled Q&P steel, but in the composition design of the alloy, no a micro Ti treatment is performed; patent CN 101775470 A introduces a process for production of a complex-phase Q&P steel, which is actually a two-step process for production of a Q&P steel; and patent CN 101487096 A introduces a C—Mn—Al Q&P steel produced using a two-step heat treating method, with the main feature being a very high elongation, but a lower strength.

Heat treatment methods are used in the above-mentioned patents, heating at the two-phase region can more easily control the volume fraction of the ferrite, but with regard to the process of hot continuous rolling, the heating temperature is generally in the full austenite region and the final rolling temperature is generally not less than 780° C., while the starting temperature of precipitation of the ferrite is mostly not less than 700° C. Therefore, it is difficult to achieve obtaining a certain amount of ferrite by reducing the final rolling temperature in the practical production by hot rolling.

SUMMARY OF THE INVENTION

An object of the present invention lies in providing a low yield ratio and superhigh-strength hot-rolled Q&P steel and a method for manufacturing the same, wherein the steel has an excellent comprehensive performance, and has a three-phase microstructure, specifically of 10-25% (by volume fraction) of proeutectoid ferrite, 65-85% of martensite and 5-10% of residual austenite, having a yield strength of ≥600 MPa and a tensile strength of ≥1300 MPa as well as a good elongation (≥10%), shows an excellent matching of high plasticity and a low yield ratio (≤0.5), and can be applied in the field of steels requiring easy deformability and wear-resistances.

In order to achieve the object mentioned above, the following technical solution is mainly used in the invention:

a low yield ratio and superhigh-strength hot-rolled Q&P steel, having the following chemical composition in weight percentage:

C: 0.2-0.3%, Si: 1.0-2.0%, Mn: 1.5-2.5%, P: ≤0.015%, S: ≤0.005%, Al: 0.5-1.0%, N: ≤0.006%, Nb: 0.02-0.06%, Ti: ≤0.03%, O: ≤0.003%, and the balance being Fe and inevitable impurities.

Preferably, in the chemical composition of said low yield ratio and superhigh-strength hot-rolled Q&P steel, in weight percentage, the content of Si is in the range of 1.3-1.7%; the content of Mn is in the range of 1.8-2.2%; the content of Al is in the range of 0.6-0.8%; the content of N is in the range of ≤0.004%; and the content of Nb is in the range of 0.03-0.05%.

The microstructure of said low yield ratio and superhigh-strength hot-rolled Q&P steel is a three-phase structure of 10-25% of proeutectoid ferrite+65-85% of martensite+5-10% of residual austenite, with a yield strength of ≥600 MPa, a tensile strength of ≥1300 MPa, and a yield ratio of ≤0.5.

In the composition design of the low yield ratio and superhigh-strength hot-rolled Q&P steel of the present invention:

on the basis of the composition of a general C—Mn steel, the content of Si is improved to inhibit the precipitation of cementite; by increasing the content of Al, on the one hand, the process of transformation kinetics of the austenite to the proeutectoid ferrite in the air cooling stage of the steel plate can be accelerated, and on the other hand, the increase of the content of Al can improve the content of carbon in the residual austenite, so as to improve the heat stability of the residual austenite, such that steel reel has more residual austenite remained in the process of slow cooling; and the addition of a trace amount of Nb or Nb+Ti can further refine the structure of the martensite lath, thus still having a better low-temperature impact toughness to the greatest extend while ensuring the superhigh-strength of the steel.

Specifically:

C: Carbon is the most basic element in steels, and also one of the most important elements in the steel of the present invention. Carbon as an interstitial atom in steels plays a very important role in increasing the strength of the steel, has the greatest effect on the yield strength and tensile strength of the steel, and also has the greatest effect on the heat stability of the residual austenite in the Q&P steel. In general cases, the higher the strength of a steel, the lower the elongation. In the present invention, in order to ensure obtaining a high-strength hot-rolled steel plate having a tensile strength of not less than 1300 MPa, the content of carbon in the steel should generally at least reach 0.2%. Where the content of carbon is lower than 0.2%, the tensile strength of the steel plate after a certain amount of ferrite is precipitated is difficult to reach not less than 1300 MPa; in addition, a lower carbon content also cannot ensure that after on-line quenching and coiling, carbon in the steel plate in the slow cooling process is fully diffused to the residual austenite from the oversaturated martensite, thus affecting the stability of the residual austenite. In another aspect, the content of carbon in the steel shall not be excessively high, wherein if the content of carbon is greater than 0.3%, although the high strength of the steel can be ensured, since the object of the present invention is obtaining a structure containing a certain volume fraction of proeutectoid ferrite+a certain volume fraction of martensite+a certain volume fraction of residual austenite, the content of carbon is excessively high, the stability of the high-temperature austenite is improved, under the existing rolling process conditions, it is difficult to ensure precipitating a certain amount of proeutectoid ferrite; moreover, the precipitation of the proeutectoid ferrite certainly causes the remaining untransformed austenite to be rich in carbon, the elongation of a high-carbon martensite obtained after quenching this part of austenite is too low, such that the elongation of the final steel plate is reduced. Therefore, with considering not only the contribution of the carbon content to the strength, but also considering the inhibition effect of the carbon content on the precipitation of ferrite and the effect on the performance of martensite, a more appropriate content of carbon in the steel of the present invention should be controlled at 0.2-0.3%, which can ensure that the steel plate has the matching of a superhigh strength and a better plasticity.

Si: Silicon is the most basic element in steels, and also one of the most important elements in the steel of the present invention. Compared with traditional hot-rolled high-strength steels, a principle of composition design of high Si is used basically in all hot-rolled high-strength Q&P steels at present. Si can inhibit the precipitation of the cementite within a certain of temperature, but has very limited effect on the inhibition of ε carbide. The inhibition of Si on the precipitation of the cementite allows carbon atoms to diffuse to the residual austenite from the martensite, thereby stabilizing the residual austenite. Although the addition of higher levels of Al and P also can inhibit the precipitation of the cementite, the high content of Al makes the steel liquid more viscous, whereby the nozzle clogging very easily occurs when continuous casting, reducing the efficiency of steel casting, and defects such as longitudinal surface cracks easily occur when the slab undergoes the continuous casting; in addition, the high content of P tends to cause a grain boundary embrittlement, such that the impact toughness of the steel plate is very low, and the weldability becomes poor. Therefore, the composition design of high Si is still one of the most important composition design principles of hot-rolled Q&P steels at present. The content of Si is generally not lower than 1.0%, otherwise, the inhibition on the precipitation of the cementite may not be effected; and the content of Si should also not exceed 2.0% in general, otherwise, hot cracking easily occurs when welding the steel plate, leading to difficulties in the application of the steel plate, and thus the content of Si in the steel is generally controlled at 1.0-2.0%, preferably in a range of 1.3-1.7%.

Mn: Manganese is the most basic element in steels, and also one of the most important elements in the steel of the present invention. As is known, Mn is an important element of increasing the austenite phase region, can reduce the critical quenching rate of the steel, stabilizes the austenite, refines the grains, and postpones the transformation from the austenite to the pearlite. In the present invention, in order to ensure the strength of the steel plate, the content of Mn should be generally controlled at not less than 1.5%, wherein if the content of Mn is excessively low, when in a first stage of air cooling of a stepped cooling, the supercooled austenite is not stable, and easily transformed into a pearlite-type-structure such as sorbite; in addition, the content of Mn should not exceed 2.5% in general, segregation of Mn easily occurs when steel-making, and heat cracking easily occurs when continuous casting of the slab. Therefore, the content of Mn in the steel is generally controlled at 1.5-2.5%, preferably in a range of 1.8-2.2%.

P: Phosphorus is an impurity element in steels. P is very easily segregated in the grain boundary; when the content of P in the steel is higher (≥0.1%), $Fe_2P$ is formed and precipitated around the grains, which reduces the plasticity and toughness of the steel; therefore, it is better that the content is lower, and the content is better controlled within 0.15% in general without increasing the costs of steel-making.

S: Sulphur is an impurity element in steels. S in the steel generally combines with Mn to form a MnS inclusion, especially when the contents of S and Mn are both higher, more MnS will be formed in the steel; moreover, MnS itself has a certain plasticity, and in the subsequent rolling process, transformation easily occurs to MnS in the rolling direction, which reduces the transverse tensile property of the steel plate. Therefore, it is better that the content of S is lower, the content being generally controlled within 0.005% in practical production.

Al: Aluminium is one of the most important alloy elements in the steel of the present invention. The basic function of Al is deoxidation in the process of steel-making. Besides, Al can further combine with N in the steel to form AlN and refine the grains. In addition to the above-mentioned functions, adding more Al in the steel of the present invention mainly has two objects: one is to accelerate the kinetics process of the transformation from the austenite to the ferrite in the air cooling stage in the stepped cooling process, and at the same time the element inhibits the precipitation of cementite together with Si; and the other is that the most important function of the addition of Al is increasing the diffusion rate of carbon atoms to the residual austenite from the martensite, thereby greatly improving the heat stability of the residual austenite, and obtaining metastable state residual austenite as much as possible at room temperature. If the content of Al in the steel is lower than 0.5%, it will be difficult for the ferrite to fully precipitate out within a few seconds of air cooling; and if the content of Al in the steel is higher than 1.0%, the steel liquid will become more viscous, whereby the nozzle clogging very easily occurs in the process of continuous casting, and defects such as longitudinal surface cracks easily occur to the continuous casting slab. Therefore, the content of Al in the steel needs to be controlled within an appropriate range, generally within 0.5-1.0%, preferably in a range of 0.6-0.8%.

N: Nitrogen is an impurity element in the present invention, and it is better that the content of S is lower. N is also an inevitable element in the steel, and in general cases, the residual content of N in the steel is between 0.002-0.004%, wherein the solid solution or free N element can be fixed by combining with acid soluble Al. In order not to increase the steel-making costs, the content of N can be controlled within 0.006%, preferably in a range of less than 0.004%.

Nb: Niobium is one of the important elements in the present invention. On the one hand, Nb can increase the non-recrystallization temperature $T_{nr}$ of the steel, so as to obtain elongated austenite grains in the process of finishing rolling and at the same time increase the dislocation density in the austenite, facilitating the precipitation and strength improvement of the ferrite in the subsequent cooling process; and on the other hand, the increase of the recrystallization temperature is beneficial for successfully performing the process of site rolling. Since the contents of carbon, silicon and manganese in the present invention are relatively high, the rolling force is large when rolling, which is adverse to the successful completion of the rolling process, and by the addition of Nb, the final rolling temperature can be increased, and the rolling force is reduced. Besides, adding a trace amount of Nb can further improve the plasticity and toughness of the steel while refining the grains and obtaining a superhigh strength and the content of Nb in the present invention is controlled at 0.02-0.06%, preferably in a range of 0.03-0.05%.

Ti: The addition amount of titanium corresponds to the addition amount of nitrogen in the steel. The contents of Ti and N in the steel are controlled within a lower range, and when hot rolling, a large amount of fine dispersed TiN particles can be formed in the steel; in addition, Ti/N in the steel needs to be controlled at not higher than 3.42 so as to ensure that Ti is fully formed into TiN. Nanoscale TiN particles which are fine and have good high-temperature stability can effectively refine the austenite grains in the rolling process; and if Ti/N is greater than 3.42, coarser TiN particles are easily formed in the steel, causing an adverse effect on the impact toughness of the steel, and coarse TiN particles can form crack sources of fractures. Generally, the addition amount of Ti may be ≤0.03%.

O: Oxygen is an inevitable element in the process of steel-making, and in the present invention, the content of O in the steel after having been deoxidated by Al can generally reach not higher than 0.003% in all cases, which will not cause an obvious adverse effect on the performance of the steel plate. Therefore, the content of O in the steel can be controlled within 0.003%.

The method for manufacturing the low yield ratio and superhigh-strength hot-rolled Q&P steel of the present invention comprises the following steps:

1) Smelting, Secondary Refining, and Casting according to the following composition, the smelting is performed using a rotary furnace or electric furnace, the secondary refining is performed using a vacuum furnace, and the casting is performed to form a cast slab or cast ingot; the contents of the chemical composition in weight percentage being: C: 0.2-0.3%, Si: 1.0-2.0%, Mn: 1.5-2.5%, P: ≤0.015%, S: ≤0.005%, Al: 0.5-1.0%, N: ≤0.006%, Nb: 0.02-0.06%, Ti: ≤0.03%, O: ≤0.003%, and the balance being Fe and inevitable impurities;

2) Heating and Hot Rolling the cast slab or cast ingot obtained in step 1) is heated to 1100-1200° C. and held for 1-2 h, with a rolling starting temperature of 1000-1100° C. and an accumulative deformation amount ≥50% after multi-pass great reduction at a non-recrystallization temperature $T_{nr}$ or higher to obtain, as a main purpose, fine equiaxed austenite grains; and then, the intermediate slab, after the temperature is between 800° C. and not higher than the $T_{nr}$, undergoes final 3-5 passes of rolling to obtain a hot-rolled piece, with the accumulative deformation amount being ≥70%;

wherein the $T_{nr}$ is determined according to the following formula, ° C.;

$$T_{nr}=887+464C+(6445Nb-644Nb^{1/2})+(732V-230V^{1/2})+890Ti+363Al-357Si;\text{ and}$$

3) Stepped Cooling the hot-rolled piece is rapidly water-cooled to 600-700° C. at a cooling rate of >30° C./s above the starting temperature of ferrite precipitation, further air-cooled for 5-10 s, then continued to be cooled to a temperature between 150-300° C. (i.e., between Ms and Mf) at a cooling rate of >30° C./s to obtain a structure of 10-25% of ferrite+65-85% of martensite+5-10% of residual austenite, and then coiled and slowly cooled to room temperature to obtain a low yield ratio and superhigh-strength hot-rolled Q&P steel with a yield strength of ≥600 MPa, a tensile strength of ≥1300 MPa, and a yield ratio of ≤0.50.

Preferably, in the method for manufacturing the low yield ratio and superhigh-strength hot-rolled Q&P steel, in the chemical composition of the hot-rolled Q&P steel in step 1), in weight percentage, the content of Si is in the range of 1.3-1.7%; the content of Mn is in the range of 1.8-2.2%; the content of Al is in the range of 0.6-0.8%; the content of N is in the range of ≤0.004%; and the content of Nb is in the range of 0.03-0.05%.

In the manufacture method of the present invention, the idea is such that:

according to a reasonable composition design, a steel plate having an excellent comprehensive performance is obtained in combination with a new process of hot rolling. In the rolling process of the present invention, a stepped cooling process is used to obtain a three-phase structure containing a certain volume fraction of proeutectoid ferrite+a certain volume fraction of martensite+a certain volume fraction of residual austenite; and by controlling the relative contents of the three different phases, a superhigh-strength hot-rolled Q&P steel having a yield strength of ≥600 MPa and a tensile strength of ≥1300 MPa is obtained.

Specifically:

If the heating temperature of the cast slab is lower than 1100° C. and the heat preservation time is excessively short, it is adverse to homogenizing the alloy elements; and when the temperature is higher than 1200° C., not only the manufacture cost is improved, but also the heating quality of the cast slab is decreased. Therefore, it is more appropriate to control the heating temperature of the cast slab of generally at 1100-1200° C.

Similarly, the heat preservation time also needs to be controlled within a certain range. If the heat preservation time is too short, the diffusion of solute atoms such as Si, Mn will be insufficient, such that the heating quality of the cast slab cannot be ensured; and if the heat preservation time is too long, the austenite grains will be coarser, and the manufacture cost will be increased; therefore, the heat preservation time should be controlled between 1-2 hours.

With the heating temperature being higher, the corresponding heat preservation time can be suitably shortened.

Since carbon and manganese are both austenite stabilization elements, and since the air cooling time cannot be very long (generally ≤10 seconds) in cases of practical production after the rapid water cooling of the first stage, on one hand, it is required to accurately control the temperature of the strip steel near a "nasal tip" (600-700° C.) where ferrite has the shortest precipitation time, on the other hand the alloy element aluminium (≥0.5%) facilitating the precipitation of the ferrite in the steel must also be added, such that enough ferrite can be precipitated within the limited air cooling time, and both are indispensable.

The length of the air cooling time is mainly dependent on the contents of C, Mn and Al in the steel. With the contents of C and Mn being higher, the content of addition of Al is also accordingly increased. If the mid-values are taken as the contents of both C and Mn, the relational formula of the cooling time and the content of Al is: cooling time $t(s)=23.7-34.3Al+15.6Al^2$, wherein Al represents the content in weight percentage (wt %).

Therefore, in the present invention, the content of Al is significantly increased in composition design, and is no less than ten times the content of Al in the general steels. The purpose of significantly increasing the content of Al lies in accelerating the precipitation of the ferrite in the air cooling stage in cases where the contents of carbon and manganese are higher. However, the content of Al also should not be excessively high, otherwise, it is easy for the steel liquid to become viscous, and the nozzle clogging very easily occurs when casting; in addition, an increase of aluminium oxide inclusions in the steel, and defects such as easy production of longitudinal cracks in the slab surface are caused. Therefore, the composition of the alloy and the process must be in close cooperation, so as to control within more accurate ranges, which is closely relates to the final mechanical properties of the steel plate.

The cooling stopping temperature of the second stage quenching after the completion of the air cooling must be controlled within a certain temperature range rather than room temperature, otherwise, the distribution of carbon atoms cannot be complete, and the quantity of the residual austenite is too low, causing the elongation of the steel plate to decrease. On-line quenching processes commonly used at present are all direct quenching to room temperature.

In addition, a further innovative point of the present invention lies in controlling the coiling temperature within a low temperature range (150-300° C.). On one hand, more residual austenite (>5%) can be remained, and the residual austenite is unstable now, wherein if being cooled to room temperature, the residual austenite will be transformed to other structures, and therefore adding a certain amount of element Si in composition design can inhibit the precipitation of carbides in the residual austenite, and reduce the consumption of carbon; and at the same time, a higher level of Al is added, so as to improve the diffusion coefficient that carbon diffuses to the residual austenite from the martensite, the heat stability of the residual austenite being improved; on the other hand, since the chemical potential of carbon atoms in the martensite is higher than that in the residual austenite, the difference of the chemical potential of the two provides a driving force for carbon atoms to diffuse to the residual austenite from the martensite, such that the content of carbon in the residual austenite is remarkably increased, and the residual austenite can be stably present at room temperature.

Generally, the higher the tensile strength of the steel plate, the higher the corresponding yield strength; and it is very difficult to obtain a very low yield strength, that is, an ultralow yield ratio, while obtaining a superhigh tensile strength. In other words, with the higher the tensile strength, the more difficult the decrease of the yield ratio. If it is desired to obtain a superhigh-strength steel having an ultralow yield ratio, a certain amount (10-25%) of a soft phase such as ferrite or austenite and a higher content (>65%) of a hard phase such as martensite, bainite must be contained in the structure of the steel, wherein since stress concentration is easily produced in the interface of the soft phase and the hard phase, and crack sources are easily formed at the soft phase/hard phase interface and rapidly extended, of a structure where the soft phase and hard phase are together, the low-temperature impact toughness is generally very poor, and the elongation is also lower.

Generally, with regard to a steel with a three-phase structure of ferrite+martensite+residual austenite, the low-temperature impact toughness is poorer; in the present invention, by adding a trace amount of Nb or Nb+Ti, the structure of martensite lath can be refined so as to improve the plasticity and toughness, thereby still having a better low-temperature impact toughness to the greatest extend while ensuring the superhigh-strength of the steel. By the ingenious cooperation of such a composition, a process and a structure, a steel plate with a structure of a certain volume fraction of ferrite+a certain volume fraction of martensite+a certain volume fraction of residual austenite can be obtained, thereby obtaining an ultralow yield ratio and superhigh-strength steel having an excellent comprehensive performance.

Advantageous effects of the present invention lie in:

1. Comparing the steel of the present invention with traditional low-alloy high-strength steels, no noble metal such as Cu, Ni, Mo is added, which greatly reduces the alloy cost. Using the hot continuous rolling process in production can further reduce the production cost with respect to a thick plate production line. Therefore, the production cost of the steel plate is very low.

2. The steel plate of the present invention has excellent mechanical properties, a lower yield strength, and a high tensile strength, and has features of an ultralow yield ratio and a superhigh strength. Therefore, a user can perform processes such as bending the steel plate without reforming the existing processing equipment, the expense of equipment reformation being saved; in addition, the mould wear is also reduced, the lifetime of the mould is prolonged, and the comprehensive use cost of the user is reduced.

3. The steel plate manufactured using the method of the present invention has characteristics of low costs, an ultralow yield ratio and a superhigh strength, and is particularly suitable for the fields where bending and shaping steel plates and wear resistance are required. The metastable state residual austenite remained in the steel can be transformed into the martensite under conditions of abrasive wear etc., which further improves the wear resistance of the steel plate.

PARTICULAR EMBODIMENTS

The invention will be further illustrated with reference to the following examples.

Figure 1:
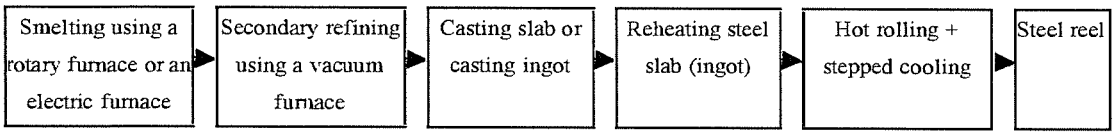
FIG. 1 is a flow chart of the process for production of the low yield ratio and superhigh-strength hot-rolled Q&P steel of the present invention.

Referring to FIG. 1, a process for production of the low yield ratio and superhigh-strength hot-rolled Q&P steel of the present invention is: smelting using a rotary furnace or electric furnace secondary refining using a vacuum furnace casting slab (ingot) reheating cast slab(ingot) a process of hot rolling stepped cooling steel reel.

EXAMPLE

Figure 2:
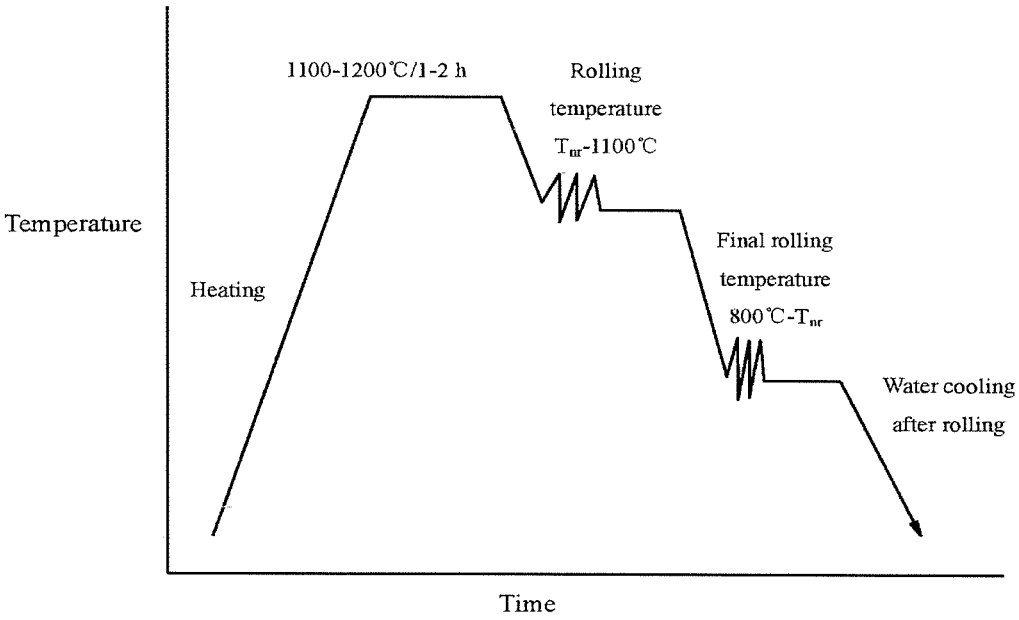
FIG. 2 is a rolling process for the low yield ratio and superhigh-strength hot-rolled Q&P steel of the present invention.
Figure 3:
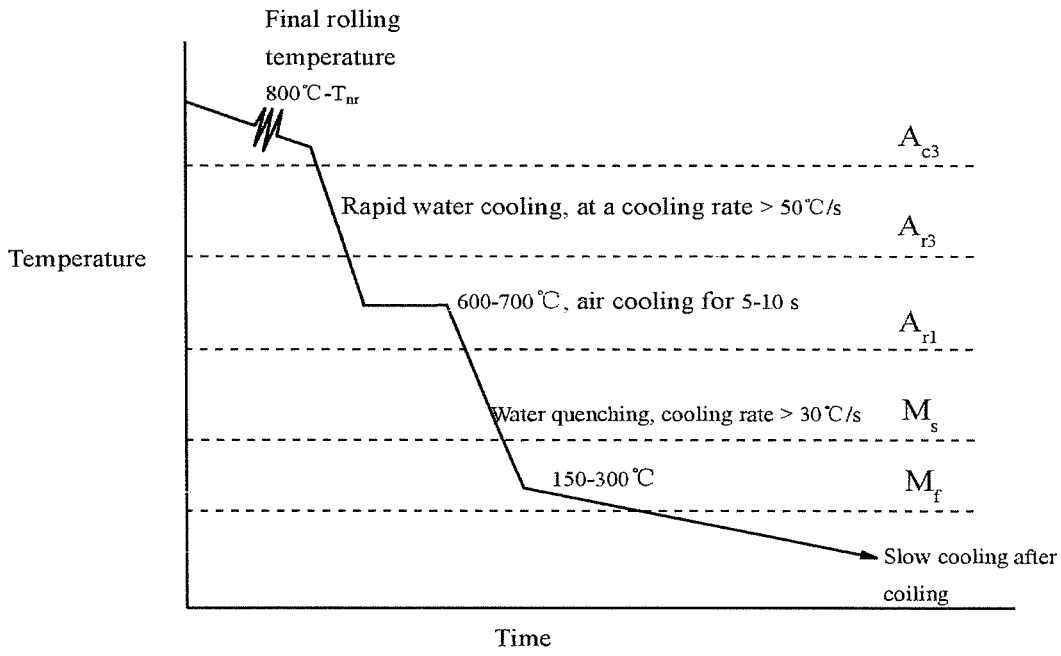
FIG. 3 is a cooling process for the low yield ratio and superhigh-strength hot-rolled Q&P steel of the present invention after rolling.
Figure 4:
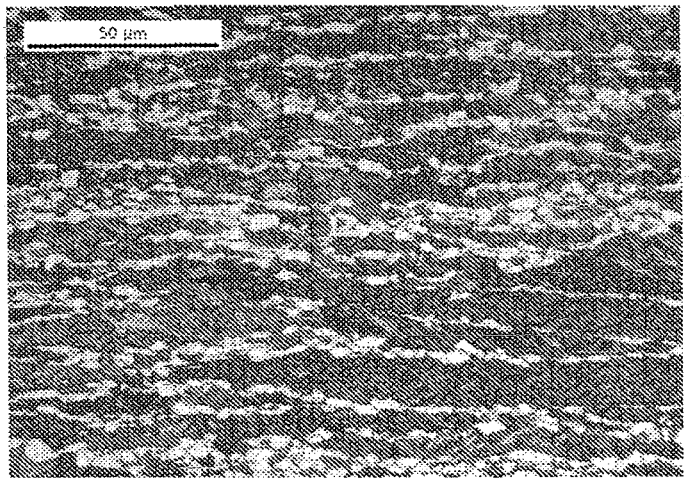
FIG. 4 is a typical metallographic photo of a test steel in example 1 of the present invention.
Figure 5:
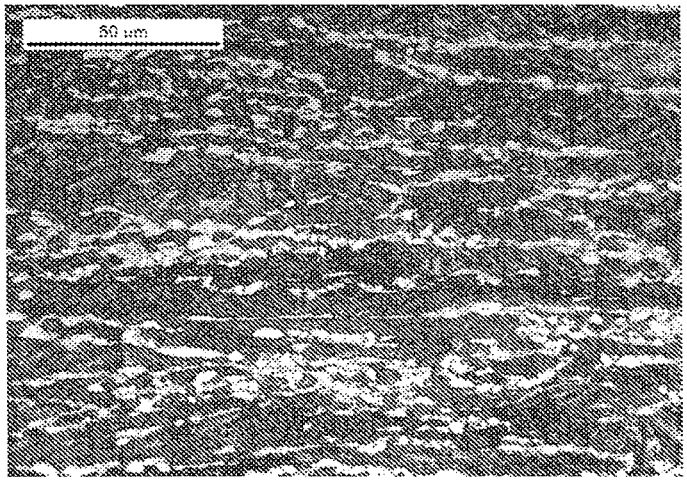
FIG. 5 is a typical metallographic photo of a test steel in example 2 of the present invention.
Figure 6:
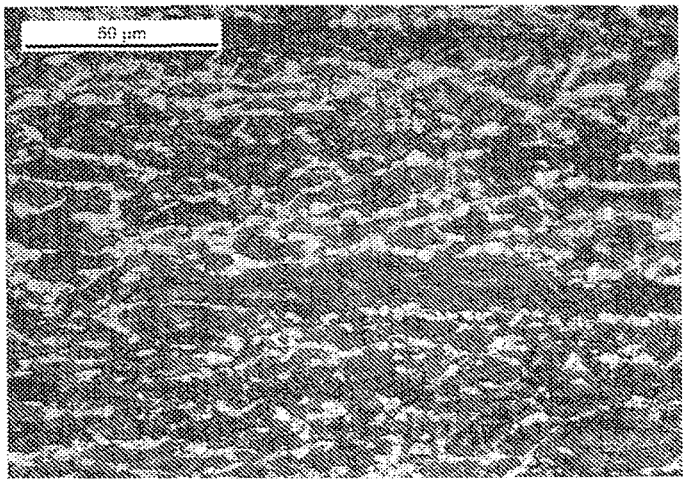
FIG. 6 is a typical metallographic photo of a test steel in example 3 of the present invention.
Figure 7:
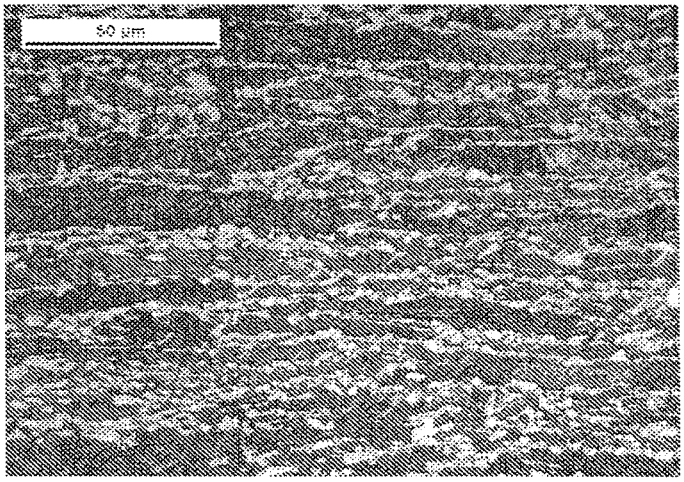
FIG. 7 is a typical metallographic photo of a test steel in example 4 of the present invention.
Figure 8:
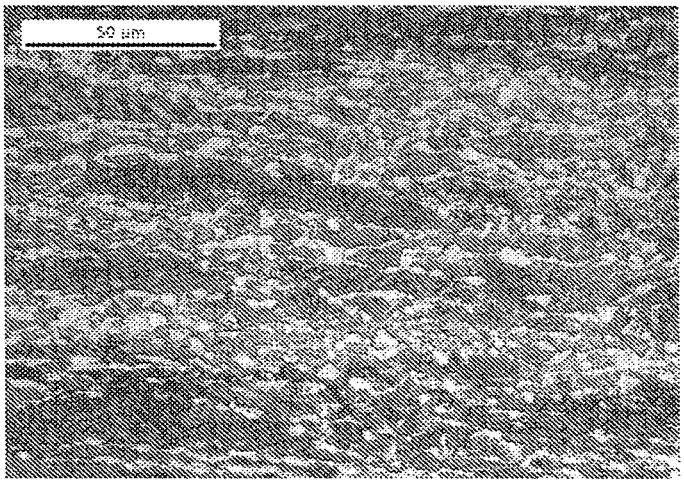
FIG. 8 is a typical metallographic photo of a test steel in example 5 of the present invention.

Referring to FIGS. 2 and 3, the process for production of low yield ratio and superhigh-strength hot-rolled Q&P steels in examples 1-5 specifically comprises the following steps:

1) Smelting, Secondary Refining, and Casting:

according to the composition of each steel in table 1, the smelting is performed using a rotary furnace or electric furnace, the secondary refining is performed using a vacuum furnace, and the casting is performed to form a cast slab or cast ingot.

2) Heating and Hot Rolling:

The cast slab or cast ingot obtained in step 1) is heated to 1100-1200° C. and undergoes heat preservation for 1-2 h, with the rolling starting temperature being 1000-1100° C., multi-pass great reduction is performed at Tnr with the accumulative deformation amount being 50%, the main purpose being obtaining fine equiaxial austenite grains; and thereafter, the intermediate slab, after the temperature is between 800° C. and not higher than the $T_{nr}$, undergoes final 3-5 passes of rolling with the accumulative deformation amount being 70%; the temperature parameters of Ms and Tnr are as shown in table 1, and the hot rolling process is as shown in FIG. 2;

wherein the $T_{nr}$ is determined according to the following formula;

$$T_{nr}=887+464C+(6445Nb-644Nb^{1/2})+(732V-230V^{1/2})+890Ti+363Al-357Si;\text{ and}$$

3) Stepped Cooling:

The hot-rolled piece is rapidly water-cooled to 600-700° C. at a cooling rate of >30° C./s above the starting temperature of ferrite precipitation, further air-cooled for 5-10 s, then continues to be cooled to a temperature between 150-300° C. (i.e., between Ms and Mf) at a cooling rate of >30° C./s to obtain a structure of 10-25% of a ferrite+65-85% of a martensite+5-10% of a residual austenite, and finally coiled and slowly cooled to room temperature to obtain a low yield ratio and superhigh-strength hot-rolled Q&P steel, wherein parameters of the rolling process (the cast slab thickness being 120 mm) are as shown in FIG. 2, the mechanical properties and microstructures are as shown in table 3, and the cooling process after rolling is as shown in table 3;

wherein the relational formula of the air-cooling time and the content of Al is:

$$t(s)=23.7-34.3Al+15.6Al^2.$$

TABLE 1

Unit: weight percentage

| Example | C | Si | Mn | P | S | Al | N | Nb | Ti | O | Ms ° C. | $T_{nr}$ ° C. |
|---|---|---|---|---|---|---|---|---|---|---|---|---|
| 1 | 0.20 | 1.57 | 1.77 | 0.008 | 0.004 | 0.66 | 0.0037 | 0.06 | 0.012 | 0.0028 | 392 | 899 |
| 2 | 0.26 | 1.55 | 1.93 | 0.008 | 0.003 | 0.87 | 0.0044 | 0.04 | 0.003 | 0.0027 | 353 | 902 |
| 3 | 0.30 | 1.16 | 1.52 | 0.007 | 0.004 | 0.75 | 0.0045 | 0.02 | 0.011 | 0.0022 | 353 | 932 |
| 4 | 0.23 | 1.84 | 2.48 | 0.009 | 0.005 | 0.98 | 0.0060 | 0.05 | 0.020 | 0.0029 | 346 | 889 |
| 5 | 0.25 | 1.25 | 2.26 | 0.007 | 0.003 | 0.52 | 0.0055 | 0.05 | 0.018 | 0.0023 | 351 | 940 |

$T_{nr} = 887 + 464C + (6445Nb - 644Nb^{1/2}) + (732V - 230V^{1/2}) + 890Ti + 363Al - 357Si$

TABLE 2

| Example | Heating Temperature ° C. | Final rolling Temperature ° C. | Steel plate Thickness mm | Cooling stopping temperature in the 1st stage, ° C. | Air cooling time in the 2nd stage, s | Cooling stopping temperature in the 3rd stage, ° C. |
|---|---|---|---|---|---|---|
| 1 | 1180 | 800 | 8 | 600 | 5 | 250 |
| 2 | 1130 | 850 | 12 | 650 | 9 | 190 |
| 3 | 1150 | 900 | 6 | 690 | 10 | 220 |
| 4 | 1100 | 880 | 3 | 660 | 6 | 160 |
| 5 | 1200 | 830 | 10 | 630 | 8 | 300 |

TABLE 3

| | Mechanical property | | | | | | | |
|---|---|---|---|---|---|---|---|---|
| | Yield | Tensile | | | −20° C. | Volume fraction of each phase, % | | |
| Example | strength Rp0.2 MPa | strength Rm MPa | Elongation A % | Yield ratio Rp0.2/Rm | Impact work J | Ferrite | Martensite | Residual austenite |
| 1 | 652 | 1379 | 11.5 | 0.47 | 49 | ~25 | ~70 | 5.46 |
| 2 | 661 | 1333 | 11.0 | 0.50 | 36 | ~25 | ~65 | 9.69 |
| 3 | 651 | 1328 | 10.5 | 0.49 | 30 | ~20 | ~70 | 9.97 |
| 4 | 666 | 1335 | 11.5 | 0.50 | 43 | ~20 | ~70 | 9.04 |
| 5 | 687 | 1374 | 10.0 | 0.50 | 38 | ~15 | ~75 | 9.34 |

By detection, the typical metallographic photos of the low yield ratio and superhigh-strength hot-rolled Q&P steels obtained in examples 1-5 are respectively as shown in FIGS. 4-8.

FIGS. 4-8 provide the typical metallographic photos of the test steels in examples. It can be clearly seen from the metallographic photos that the structure of the steel plate is mainly a small amount of proeutectoid ferrite+martensite+residual austenite. It can be seen according to the X-ray diffraction results that the contents of the residual austenites in the steel plates in examples 1-5 are respectively 5.46%, 9.69%, 9.97%, 9.04% and 8.34%.

The microstructure of the steel plate of the present invention strip-shaped proeutectoid ferrite+martensite+residual austenite. Due to the presence of the residual austenite, a transformation-induced plasticity (TRIP) effect occurs to the steel plate in the process of extension or wearing, thereby improving the wear resistance of the steel plate.

The invention claimed is:

1. A low yield ratio and superhigh-strength hot-rolled Q&P steel, having the following chemical composition in weight percentage:

C: 0.2-0.3%, Si: 1.3-2.0%, Mn: 1.5-2.5%, P: ≤0.015%, S: ≤0.005%, Al: 0.75-1.0%, N: ≤0.006%, Nb: 0.02-0.06%, Ti: ≤0.03%, O: ≤0.003%, and the balance being Fe and inevitable impurities, and Ti/N≤3.42, wherein said Q&P steel has a yield strength of 600 MPa, a tensile strength of ≥1300 MPa, and a yield ratio of ≤0.5, and wherein the microstructure of said Q&P steel is a three-phase structure consisting of 10-25% (v/v) of proeutectoid ferrite, 65-85% (v/v) of martensite, and 5-10% (v/v) of residual austenite.

2. The low yield ratio and superhigh-strength hot-rolled Q&P steel according to claim 1, characterized in that said chemical composition, the content of Si is in the range of 1.3-1.7%.

3. The low yield ratio and superhigh-strength hot-rolled Q&P steel according to claim 1, characterized in that the content of Mn is in the range of 1.8-2.2% in weight percentage.

4. The low yield ratio and superhigh-strength hot-rolled Q&P steel according to claim 1, characterized in that the content of Al is in the range of 0.8-1.0% in weight percentage.

5. The low yield ratio and superhigh-strength hot-rolled Q&P steel according to claim 1, characterized in that the content of N is in the range of ≤0.004% in weight percentage.

6. The low yield ratio and superhigh-strength hot-rolled Q&P steel according to claim 1, characterized in that said chemical composition, the content of Nb is in the range of 0.03-0.05%.

7. A method for manufacturing the low yield ratio and superhigh-strength hot-rolled Q&P steel according to claim 1, characterized by comprising the following steps:

1) smelting, secondary refining, and casting smelting by using a rotary furnace or electric furnace, secondary refining by using a vacuum furnace, and casting to form a cast slab or cast ingot, according to the following chemical composition in weight percentage: C: 0.2-0.3%, Si: 1.3-2.0%, Mn: 1.5-2.5%, P: ≤0.015%, S: ≤0.005%, Al: 0.75-1.0%, N: ≤0.006%, Nb: 0.02-0.06%, Ti: ≤0.03%, O: ≤0.003%, and the balance being Fe and inevitable impurities, with Ti/N≤3.42;

2) heating and hot rolling heating the cast slab or cast ingot to 1100-1200° C. and holding for 1-2 h, with a rolling starting temperature of 1000-1100° C. and an accumulative deformation amount of ≥50% after multi-pass large reduction at a non-recrystallization temperature $T_{nr}$ or higher to obtain an intermediate slab containing fine equiaxed austenite grains; and then rolling for 3-5 passes with an accumulative deformation amount of 70% after the temperature of the intermediate slab reaches a temperature in the range of $T_{nr}$ or less to 800° C. to obtain a hot-rolled piece; wherein the non-recrystallization temperature $T_{nr}$ is determined according to the following formula, in which various element symbols respectively represent the corresponding contents in weight percentage of the elements;

$$T_{nr}=887+464C+(6445Nb-644Nb^{1/2})+(732V-230V^{1/2})+890Ti+363Al-357Si;\text{ and}$$

3) stepped cooling rapidly water-cooling the hot-rolled piece from a temperature above a starting temperature of ferrite precipitation to 600-700° C. at a cooling rate of >30° C./s, air-cooling for 5-10 s, and continuing the cooling to a temperature between 150-300° C. at a cooling rate of >30° C./s, then coiling and slowly cooling to room temperature to obtain said low yield ratio and superhigh-strength hot-rolled Q&P steel.

8. The method for manufacturing the low yield ratio and superhigh-strength hot-rolled Q&P steel according to claim 7, characterized in that the low yield ratio and superhigh-strength hot-rolled Q&P steel obtained by the manufacturing method has an elongation of ≥10%.

9. The low yield ratio and superhigh-strength hot-rolled Q&P steel according to claim 1, wherein said Q&P steel has an elongation of ≥10%.

* * * * *